United States Patent [19]

Karidis

[11] Patent Number: 4,681,467

[45] Date of Patent: Jul. 21, 1987

[54] IMPACT PRINTING APPLICATIONS

[75] Inventor: John P. Karidis, Ossining, N.Y.

[73] Assignee: International Business Machinces Corporation, Armonk, N.Y.

[21] Appl. No.: 887,983

[22] Filed: Jul. 25, 1986

Related U.S. Application Data

[63] Continuation of Ser. No. 726,206, Apr. 23, 1985, abandoned.

[51] Int. Cl.[4] ..... B41J 3/10

[52] U.S. Cl. ..... 400/124; 101/93.05; 400/121; 335/282

[58] Field of Search ..... 400/124, 121; 101/93.04, 93.05; 335/282, 300; 336/61

[56] References Cited

U.S. PATENT DOCUMENTS

| | | | |
|---|---|---|---|
| 2,099,997 | 11/1937 | Benecke | 336/61 X |
| 3,138,427 | 6/1964 | Stein | 101/93.23 X |
| 3,973,661 | 8/1976 | De Boo | 400/124 |
| 4,368,353 | 1/1983 | Ando | 400/124 X |
| 4,396,304 | 8/1983 | Davenport | 400/124 |
| 4,407,591 | 10/1983 | Adamoli | 400/124 |
| 4,411,538 | 10/1983 | Asano | 400/124 |
| 4,449,836 | 5/1984 | Yamada | 400/124 |
| 4,527,469 | 7/1985 | Wolf | 400/121 X |

FOREIGN PATENT DOCUMENTS

| | | | |
|---|---|---|---|
| 194576 | 11/1983 | Japan | 400/124 |
| 32110 | 2/1984 | Japan | 400/719 |

OTHER PUBLICATIONS

*IBM Tech. Disc. Bulletin,* by W. Hasler, vol. 25, No. 9, Feb. 1983, pp. 4901–4902.

*Primary Examiner*—Paul T. Sewell

*Attorney, Agent, or Firm*—Sughrue, Mion, Zinn, Macpeak, and Seas

[57] ABSTRACT

A print actuator for dot matrix applications having a stator with a coil wrapped thereon and constrained by the walls of the stator. An armature extends above the stator in a cantilever or pivoted manner. The armature controls movement of a print element. The magnetic flux path extends transversely through the width of the armature and the periphery of the stator at walls supporting the armature. Multiple armatures are included in a common armature plate. Twin multi-coil stators are mounted for operation of the armatures on the plate. The stators have magnetic stator sections adjacent the armatures, and have non-magnetic heat-dissipating stator sections remote from the armatures. In its cocked position, the armature is flexed to a profile which optimizes armature dynamics, such as a profile similar to the first bending mode.

25 Claims, 10 Drawing Figures

IMPACT PRINTING APPLICATIONS

This is a continuation of application Ser. No. 726,206, filed Apr. 23, 1985, abandoned.

DESCRIPTION

1. Technical Field

This invention relates to actuators for use in printing mechanisms, and in particular relates to a compact multi-coil print actuator using lightweight armatures mounted along gaps between poles of a stator to complete transverse flux paths.

2. Prior Art

The art is replete with electromagnetic print actuator devices. Such devices seek to achieve high speeds and greater print density using a variety of actuator configurations. Wire matrix printers, in particular, seek to increase print density by decreasing the distance between adjacent actuator wires. Consequently, a standing requirement in this field is to reduce overall actuator size.

U.S. Pat. No. 3,138,427 describes a facsimile system utilizing a transducer assembly comprising an armature, coil and a core comprising leg elements. A marking member is clamped to one leg. The amount of pressure exerted by the forward longitudinal edge of the marking element is a function of the energization of the winding from the source.

A moving coil assembly, as illustrated in U.S. Pat. No. 3,780,650, employs a coil with pole pieces positioned between pole plates. The magnetic reluctance is reduced by having the pole pieces arranged with the air gaps parallel to each other. *IBM Technical Disclosure Bulletin,* Volume 21, Number 11, pp. 4452–4453 (April 1979) discloses a print hammer assembly employing a bank of print hammers individually supported on a base by means of a cantilever arrangement. Armature poles have coils wound in series on bobbins placed over the armature poles. The flux path is minimized due to the series winding of the coils and is disposed in a longitude direction aligned with the direction of movement of the spring hammer elements. A variation of this mechanism is shown in *IBM Technical Disclosure Bulletin,* Volume 28, Number 9, pp. 4901–4902 (February 1983). The actuator disclosed therein employs a print hammer cantilever-mounted on a magnet yoke carrying an energizing coil, a spherical stop and a rest stop. The rest stop includes a permanent magnet for biasing the print hammer into a rest position. Upon energization of the coil, the armature flexes, deflecting the hammer element about the spherical stop which acts as a fulcrum. Another example of a print hammer mechanism employing a pivoting print finger is illustrated in *IBM Technical Disclosure Bulletin,* Volume 22, Number 8B, pp. 3536–3537 (January 1980). The actuator therein employs a holding magnet and a separate coil for purposes of releasing the print finger from its retaining structure.

A somewhat different arrangement is illustrated in *IBM Technical Disclosure Bulletin,* Volume 23, Number 5, pp. 1765–1766 (October 1980). Print wires are driven by piston and held in a home position by means of a magnetic circuit including housings and a permanent magnet. A coil bobbin assembly having magnetic return elements is offset relative to the travel of the print wire. The magnetic flux path acts in a direction aligned with the travel of the print wire.

Other art considered, but deemed less germane to this invention, is disclosed in *IBM Technical Disclosure Bulletin,* Volume 22, Number 8A, pp. 3171–3172 (January 1980) and Volume 22, Number 8B, pp, 3672 (January 1980). Those disclosures relate to electronic techniques for flight time control of print hammers. Also considered, soley for purposes of the magnetic circuit, is the U.S. Pat. No. 2,202,729, which discloses a coil, armature and pole pieces. The relay disclosed in that patent is not considered pertinent to a print hammer assembly.

SUMMARY OF THE INVENTION

Given the deficiencies in the prior art, it is an object of this invention to define an easily-manufacturable, high-density print-head-assembly for use in wire matrix printers.

Yet another object of this invention is to define an impact printer actuator which provides a large area of armature/pole face overlap on a low-mass armature.

Yet another object of this invention is to provide a print-hammer actuator assembly that employs a stator having, for each actuator, a transverse magnetic flux path. By employing a transverse magnetic flux path, individual flux paths may be used when isolated coils are selected; however, a common flux path can be shared in situations where actuation of adjacent coils is sought.

It is another object of this invention to provide a print hammer actuator that employs a stator assembly wherein magnetic flux paths for adjacent actuators have opposing polarities in the stator and transverse magnetic flux paths across the armatures.

Another object of this invention is to define an actuator having compact electrical connections to an integral stator, thereby further reducing the size of the device.

Another object of this invention is to provide an armature rest with a profile which configures the armature for optimum dynamics upon actuation.

These and other objects of this invention are achieved in a high speed actuator for use in impact printers. The device employs a coil positioned on a stator which provides a magnetic flux path transversely across the width of an armature. The armature is provided as a separate clapper element disposed at the periphery of the coil. Pole pieces, as needed, can be employed. The magnetic circuit, therefore, employs a transverse magnetic flux path which allows adjacent armatures to share a common flux path when those adjacent elements are selected for printing. However, individual flux paths are present when isolated coils are selected. Alternatively, adjacent coils may have an opposite polarity to eliminate magnetic interaction.

The stator may comprise a solid ferrous core or a lamination of thin sections to reduce eddy currents. The stator may also include a heat-sink section of non-magnetic but heat-conductive material such as aluminum to define an efficient thermal transfer path. Terminal connections may be provided by circuit boards or flexible printed-circuit cables mounted to the stator and conforming in configuration to the gaps for the coil.

This invention will be described in greater detail by referring to the attached drawings and the description of the preferred embodiment which follows.

BRIEF DESCRIPTION OF THE DRAWINGS

FIG. 1 is an end view of an embodiment of an actuator in accordance with this invention;

FIG. 2 is a sectional view along line 2—2 illustrated in FIG. 1;

FIG. 3 is a semischematic sectional view of a one-piece stator having a plurality of independent coils wrapped thereon forming a multi-actuator assembly using constant polarity;

FIG. 4 is a semischematic sectional view of a one piece stator employing alternating polarity;

FIG. 5 is a semischematic elevation view of a multi-actuator armature plate;

FIG. 6 is a perspective view of a preferred embodiment of a laminated stator array;

FIG. 7 is an elevation view of a second preferred multi-actuator armature-plate;

FIG. 8 is a sectional view along line 8—8 of FIG. 7, showing construction details and illustrating the stator profiled for optimum dynamics.

DETAILED DESCRIPTION OF THE PREFERRED EMBODIMENT

FIGS. 1–5 illustrate the invention in a simplified general embodiment.

Figure 2:
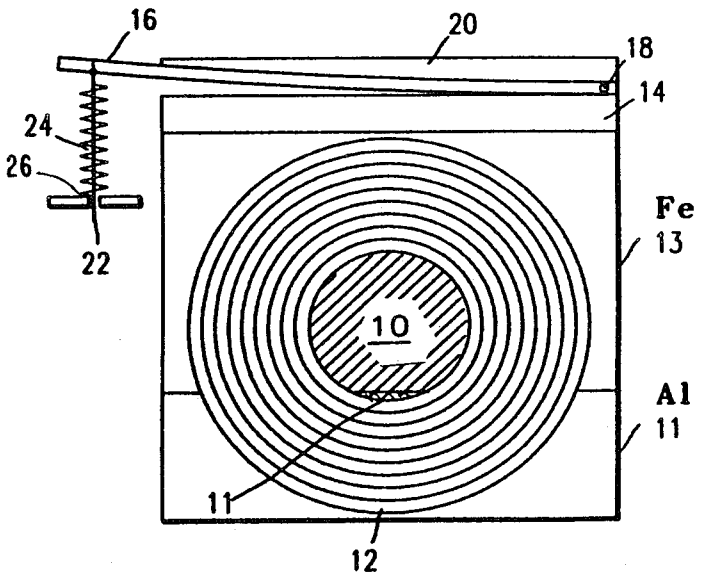
FIGS. 1–5 illustrate the invention in a simplified general embodiment.
Figure 1:
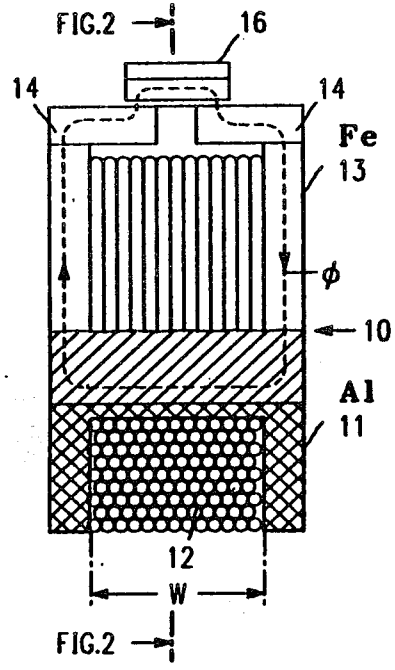

Referring now to FIGS. 1 and 2, a single actuator stator 10 is shown in partial section. The stator 10 serves as a winding bobbin for a coil 12. The stator has a generally H-shape wherein the vertical walls serve as poles and confine in a slot the coil 12 to define the bobbin winding area. This technique provides an effective heat transfer path from the coil through the core and into ambient air. It thereby allows higher input power and higher duty cycles for the actuator without damaging the coil. Cost is reduced by eliminating the requirement of a separate coil bobbin and its subsequent assembly onto the actuator.

The stator 10 includes a non-magnetic stator section 11 and a magnetic stator section 13. The magnetic stator section 13 is limited to the areas of desired magnetic flux and includes the vertical walls serving as poles; the non-magnetic stator section 11 completes the physical package for coil support, and serves as a heat transfer medium. Materials may be varied, but iron (Fe) for magnetic and aluminum (Al) for non-magnetic are shown.

Pole plates 14 are disposed on the stator 10 and an armature 16 is clamped above the pole plates 14. The pole plates 14 permit a narrow armature 16 to be employed in conjunction with a wide coil 12. This improves actuator efficiency since resistance losses in the coil are inversely proportional to the cross sectional area of the coil.

Alternatively, the pole plates 14 can be eliminated and the armature 16 made slightly wider than the coil 12 to rest on the stator 10. The stator 10 may also be manufactured utilizing sintered iron to have a shape approximately like the combination of the core and pole plates.

The coil 12 is illustrated in FIG. 1 as a conventional circular wire. It is possible to employ a thin ribbon wire having a width W and wound on itself as a continuous tape around the stator 10 in the slot. In this case, a complete bobbin is not necessary since the flat ribbon wire will not spread.

Magnetic components are ferromagnetic; non-magnetic components are diamagnetic or weakly ferromagnetic as is known in the art. Magnetic components, that is the stator 10, the pole plates 14, and the armature 16, may be machined from iron, magnetic steel, silicon iron or the like or alternatively may be formed using sintered iron and standard powder-metallurgy techniques.

FIG. 1 illustrates the magnetic flux path through the actuator. The magnetic flux path through the armature 16 is in the transverse direction. That is, the flux flows into the armature along one edge (left side), passes across the width of the armature, and then returns to the core through the opposite edge (right side). The lower portions of the core serve only to contain the coil. As illustrated in FIG. 1, the desired flux does not flow through the lower portion of the core, especially with a non-magnetic material such as the aluminum heat-sink of FIGS. 1 and 2.

The transverse flux path permits the armature 16 to be very thin and accordingly very light without saturation and yet providing a large total air-gap area. The large air-gap area produces large magnetic forces on a low-mass armature. This results in high acceleration and fast response.

As illustrated in FIG. 2, the armature 16 is fixed about a point 18, that is, clamped between the pole plates 14 and a back-up plate 20. The armature could be relatively rigid and pivot about point 18, but for low-energy applications such as wire matrix printing, the preferred armature is a thin flexing cantilever beam rather than a rigid pivoting body.

The back-up plate 20 serves to limit the travel of the free end of the armature. Given the large contact area between the armature and the back-up plate 20, an improvement in the settle-out characteristics of the armature is achieved. The back-up plate, not forming a part of the magnetic circuit, is preferably molded of an energy-absorbent polymer, and has a profile chosen to provide optimum armature settle-out (e.g., the static deflection profile of the end-loaded cantilever beam 16). Armature attachment by other techniques may be employed. For example, the armature and stator can each be mounted to a third member forming a mounting structure supporting both the stator 10 and armature 18.

FIG. 2 also illustrates schematically the remaining components of the actuator, including print wire 22 suspended on the cantilever armature 16, and a compression return spring 24. The return spring has one end fixed to a rigid point 26 with the other end coupled to the armature 16. Consequently, the armature 16 is normally biased and flexed upward by the compression spring 24, placing the print wire 22 in the at-rest position shown. Actuation causes the armature 16 to be electromagnetically driven in a direction downward toward the core 10, thereby overcoming the bias provided by the compression spring 24 and placing the wire 22 in a print contact position.

FIG. 2 illustrates one mode of operation where the actuator pushes the print wire 22 towards a ribbon and paper (not illustrated) whenever the coil is energized. An alternative mode is to hold magnetically the armature and print wire cocked against a spring force whenever printing is not required, and then to release the armature 14 when a dot is required. In this so-called "pick-and-hold" operation, the armature itself can provide the spring force through bending. The stored energy is employed to accelerate the wire into the ribbon and the paper. The coil may be energized with a relatively low current to hold the armature back. The armature can then be released by temporarily stopping the coil current. The armature can then be restored to the "hold" position with a short burst of high current in the coil. This mode of operation allows for simplification of the actuator structure, eliminates the cost and space requirements of the permanent magnets used in other stored-energy designs, and allows for more compact packaging. It does, however, incur a penalty in power requirements since power is being dissipated in the printhead even when it is not printing. This power problem can be controlled if the printhead or the platen can be retracted under electronic control, thereby allowing the armatures to be released without marking the paper when the printer is not receiving any data.

A typical movement for the armature is in the range of 0.35 mm with an actuation time of approximately 250–300 microseconds. In some cases the print wire may have some overtravel, or "ballistic" flight associated with its motion following stoppage of the armature. Cycle times in the range of 500 microseconds or less can be achieved.

Figure 3:
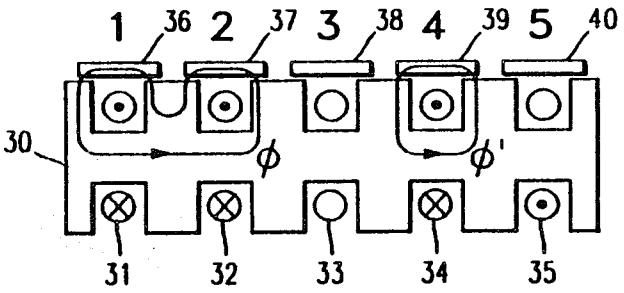

Referring now to FIG. 3, a further modification of this invention is illustrated; using a common stator for several print positions. While the overall number of parts in the actuator assembly of FIG. 1 is small, a further decrease can be achieved by packaging groups of actuators as illustrated in FIG. 3. A one-piece stator 30 has a plurality of coils 31–35 wrapped upon it in respective slot. The armature elements 36, 37, 38, 39 and 40 are disposed on the stator 30. Consequently, FIG. 3 illustrates five effective actuators disposed on a single core. As long as the vertical portions of the stator 30 do not severely saturate, any combination of coils may be actuated without firing any of the actuators whose coils are not actuated.

FIG. 3 illustrates the dominant magnetic flux path for the gang of five actuators wherein actuator coils 1, 2 and 4 have been energized. The flux path through adjacent sections 1 and 2 is such that they are energized with a similar polarity so that the magnetic flux bypasses the vertical core segment separating the two coils. Instead, the flux path $\phi$ circulates around both coils, passing through armatures 36 and 37 in the process. Both the magnetomotive force driving this flux path and the reluctance of the path are twice that of a single actuator. Thus, the armatures 36 and 37 experience the same total flux flow, irrespective of whether a neighboring actuator has been energized. Actuator 4 has a flux path $\phi'$, consistent with that shown in FIG. 1.

As illustrated in FIG. 3, for actuator 3 not energized, there is no significant flux flowing through its armature because the unsaturated vertical core pieces isolate the actuator from the flux flowing in the neighboring core segments.

Figure 4:
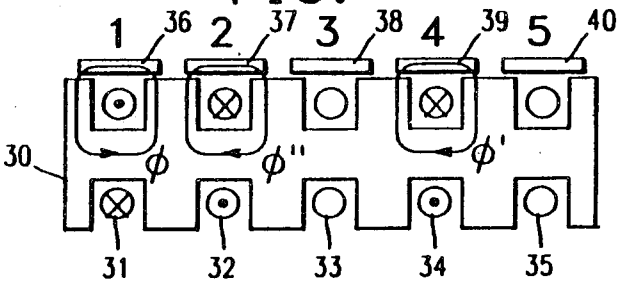

FIG. 4 illustrates the same structure as FIG. 3; however, the coils 31–35 have an alternating polarity along the length of the stator 30. This technique of having coils 31, 33 and 35 with a flux path $\phi$ and coils 32, 34 . . . a flux path $\phi''$ eliminates the possibility of an unacceptably large quantity of flux flowing through an inactive actuator if a large number of actuators are fired on each side on an actuator that is to remain inactive. It is understood that other potential driving arrangements exist, including the use of bipolar drivers to set the polarity of adjacent coils as a function of the pattern being printed. Thus, this invention is not limited to a particular arrangement of coil polarities.

Figure 5:
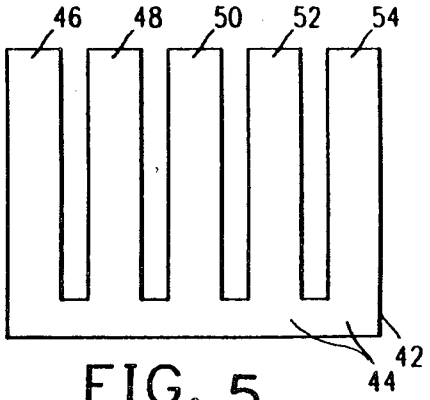

A further reduction in the total number of parts for a multi-actuator assembly can be achieved if cantilever armatures are combined in a comb-plate configuration as illustrated in FIG. 5. The armature 42 comprises a base portion 44 and five comb-like fingers 46, 48, 50, 52 and 54. This individual plate would replace the five individual armature pieces 36, 37, 38, 39 and 40 in FIG. 3. Because the armature is thin, the amount of flux which can bypass the air gaps by traveling through the continuous edge of the comb-plate will be small. This will not substantially affect the magnetic force on the armature. Consequently, in accordance with this invention, it is possible to construct a single core having wound thereon N separate coils. A single comb-plate having N fingers can be constructed as the armature assembly for this device. A single back-up plate, not illustrated in FIGS. 3 and 4, but similar to that shown as element 20 in FIG. 2, can be employed. These three elements can be clamped or glued.

Figure 6:
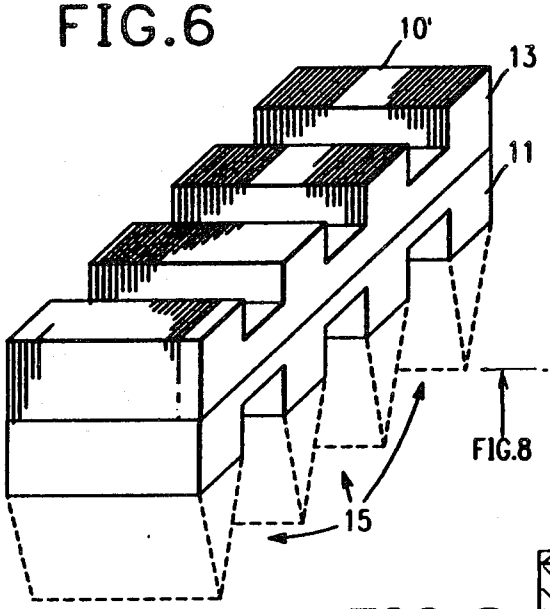

FIG. 6 illustrates a preferred stator 10' employing laminated thin ferrous laminations bonded together. The use of such a laminated assembly reduces the effects of eddy currents during high speed operation by electrically isolating each of the thin laminates. A further reduction in cost is achieved since the laminations may be stamped and simply bonded together. FIG. 6 also illustrates a linear arrangement wherein a common linear stator has multiple winding sections. To assist in defining the shape of the bobbin for coil windings, the non-magnetic stator section is a slotted bar 11 of non-ferrous material such as aluminum, bonded back-to-back against the magnetic stator section 10'. It is noted that the same function could be obtained with a stator bar having coil slots on top and bottom; however, flux leakage through the inactive slots tends to degrade the performance of the actuators. By making the slots 15 relatively deep vis-a-vis coil depth, the aluminum bar 11 acts as a finned heat-sink to dissipate the heat, generated in the coil, to the ambient air. The intimate coupling of the coils to the aluminum fins provides a very efficient thermal transfer path, thus reducing the peak printhead temperatures associated with a particular level of power dissipation. The heat dissipating fins may take many forms, as is shown in phantom in FIG. 6.

Figure 7:
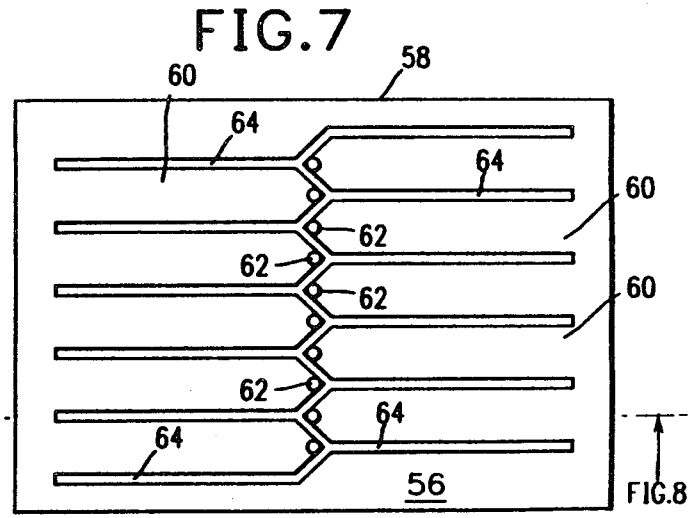
FIGS. 6–8 illustrate the invention in a practical embodiment.
Figure 8:
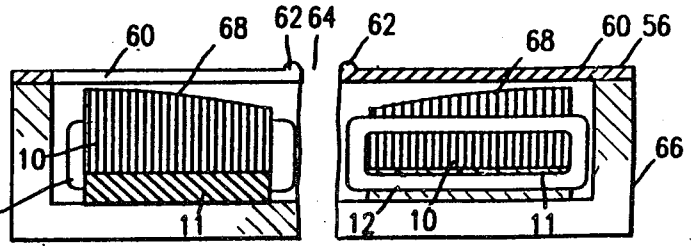

FIGS. 7 and 8 illustrate a common armature plate 56 for a serial printhead operated in a "pick and hold" mode as described herein. The armature plate 56 is used in conjunction with two stator bars (not shown) of appropriate length. Print wires are replaced with a series of small protrusions 62 integrally formed on the armature plate 56. Slots 64 are used to isolate the armatures 60 from each other. The armature plate 56 is mounted along its periphery 58. The armature plate 56 is manufactured by first embossing protrusions 62 on a flat plate. The slot pattern 64 is then etched through the plate to define the beam elements 60. It is understood that alternative techniques of manufacture may be employed.

FIG. 8 shows a twin-stator assembly for use with the common armature plate of FIG. 7 (or its assembled equivalent). Common armature plate 56 is mounted on structural support 66, which is shown as if divided to show print protrusions 62 unobscured on each armature 60. Note that coils 12 and stators 10 also are slightly interleaved. Support 66 may be opened at windows for cooling fins 15 of FIG. 6, or may be otherwise complementary to enhance heat dissipation.

Stators 10 have profiled top surfaces achieved by grinding them after assembly. The grind may simply be a smoothing grind to eliminate rough edges, but preferably is a profiling grind. The profile 68 is matched to the profile of the first free-vibrating bending mode for the cantilever beam of the armature, for best results in the "pick and hold" mode of operation. It is understood that other profiles can be used to modify the armature dynamics as required.

Figures 9, 10:
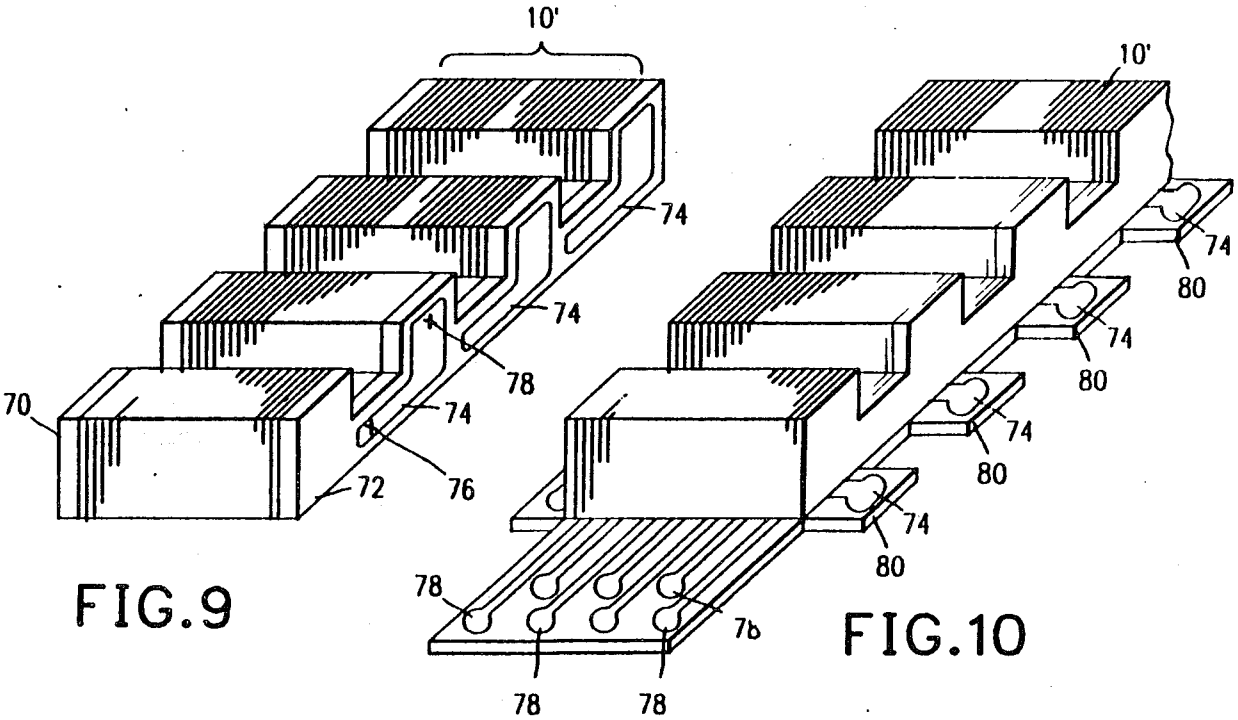
FIGS. 9 and 10 are perspective views illustrating alternative techniques of coil termination using printed circuit boards integral with the stator.

Referring to FIGS. 9 and 10, two preferred techniques of terminating the coil windings are illustrated. FIG. 9 shows a stator 10' having laminations as illustrated in FIG. 6. A pair of thin printed circuit boards 70, 72 are bonded onto each end of the ferromagnetic laminations comprising the stator 10'. Each printed circuit board has a series of copper pads 74. Before winding the coils (not shown), one end of the coil wire is connected (typically soldered) onto a printed circuit board 72 at one end of the stack, such as at point 76. Following winding, the free end of the coil is connected to the other end of the stack, such as at point 78. Each printed circuit board has appropriate wiring patterns to provide electrical isolation of the coils and also provide convenient solder pads for the final connection of the coils to the drivers.

Alternatively, as illustrated in FIG. 10, the printed circuit board 80 can be placed on the bottom of the stator 10'. The copper pads 74 would then protrude outward. The protrusions 80 would also serve as wire restraints during winding.

While illustrated in the figures as aligned in a straight line, a gang of actuators may be curved about various axes to accommodate situations where the print wires are required to converge to form a densely-packed linear cluster. As an example, the gang of actuators may be curved so that the armatures are arranged radially in a conventional wire-matrix print head configuration. The comb-plate would then take the form of a circle with the armature elements extending radially inward.

While this invention has been described relative to the preferred embodiments thereof, it is apparent that other modifications of the invention may be practiced without departing from the essential scope thereof; that is, by using a transverse magnetic flux path through the armature with the coil wrapped directly on the stator, a compact multi-coil print actuator is defined.

Having thus described my invention, what I claim as new, and desire to secure by Letters Patent is:

1. A print actuator comprising:

a stator having a centersection and having at least one slot defined by a plurality of vertically extending poles at a periphery and made from a ferromagnetic material;

a coil disposed about a central portion of said stator centersection, having its axis approximating the axis of said stator, constrained by said vertically extending poles of said stator;

an armature disposed perpendicular to the axis of said coil and extending across said slot between said poles; and wherein a magnetic flux path extends vertically through one of said poles, transversely through the width of said armature in a direction parallel to the axis of said coil, and vertically through the other of said extending poles.

2. The actuator of claim 1, wherein said stator comprises pole plates disposed on said vertically extending poles and partially bridging the slot between said poles and said armature is disposed above said pole plates, wherein the flux path passes through the periphery of said stator at said vertically extending poles supporting said pole plates, passes through said pole plates and passes transversely through the width of said armature.

3. The actuator of claim 1, wherein said stator comprises a portion made of a non-magnetic material.

4. The actuator of claim 1, wherein said armature is flexibly mounted from a cantilever mounting at its mounting end.

5. The actuator of claim 1, further comprising a back-up plate for said armature, said armature being resilient and cantilevered from said back-up plate at a clamping point, having a profile similar to the first bending mode of the cantilever beam of said armature in order to improve settle-out dynamics.

6. The actuator of claim 5, wherein said back-up plate comprises an energy-absorbent material having a contact area with said armature.

7. The actuator of claim 5, wherein said print element comprises a print wire attached to an end of said armature opposite the cantilever end and bias means to urge said print wire in a direction of movement causing said armature to contact said back-up plate.

8. The actuator of claim 1, further comprising N core sections integrally formed to define a common stator section, N coils wound individually about said N core sections and an armature associated with each of said N core sections.

9. The actuator of claim 8, wherein said armature comprises a unitary structure having N arms extending from a common base, each of said N arms disposed over an associated slot in said core section.

10. The actuator of claim 9, further comprising a back-up plate over said unitary structure.

11. The actuator of claim 8, wherein said common stator is curved so as to converge print elements into a cluster.

12. The actuator of claim 1, wherein said stator section comprises a series of thin ferromagnetic laminations bonded together to form said stator section.

13. The actuator of claim 1, wherein said stator comprises a heat-sink attached to said stator section, said heat-sink having a center section aligned with the center sections of said stator section, and said coils are wound around said stator section and said heat-sink in said aligned center sections.

14. The actuator of claim 9, wherein said unitary structure comprises a base plate, a series of N arms interleaved and each formed in said base plate with one end coupled thereto and, print elements located at opposite free ends of each of said N arms.

15. The actuator of claim 1, further comprising a circuit board coupled to said stator section and having terminals for connecting ends of said coil in an operable electrical circuit.

16. The actuator of claim 15, wherein said circuit board comprises a pair of circuit boards mounted at ends of said stator section.

17. The actuator of claim 15, wherein said circuit board comprises a single board mounted under said stator section and having protrusions extending outwardly therefrom.

18. The actuator of claim 1, wherein said armature pivots about a mounting point at its mounting end.

19. The actuator of claim 3, wherein said stator non-magnetic section includes heat-dissipating means.

20. The actuator of claim 4, comprising a profiled rest for said armature.

21. The actuator of claim 20, wherein said profiled rest is approximately matched to the bending profile of the cantilever armature beam.

22. The actuator of claim 21, wherein said profiled rest is the top of the vertically extending poles of said stator.

23. The actuator of claim 22, wherein said profiled rest is formed by precision grinding.

24. The actuator of claim 2, comprising a profiled rest for said armature, wherein said profiled rest is the top of said pole plates.

25. The actuator of claim 2, wherein said coil has a finite width greater than the gap between said pole plates, and said armature has a finite width slightly greater than the gap between said pole plates but smaller than the width of said coil.

* * * * *